United States Patent [19]

Varlemann

[11] Patent Number: 4,513,653

[45] Date of Patent: Apr. 30, 1985

[54] AUTOMATIC HYDRAULIC REVERSING VALVE FOR A DOUBLE-ACTION WORKING CYLINDER

[76] Inventor: Kurt Varlemann, Eidinghausener Strasse 117, D-4970 Bad Oeynhausen, Fed. Rep. of Germany

[21] Appl. No.: 496,297

[22] Filed: May 13, 1983

[30] Foreign Application Priority Data

May 17, 1982 [DE] Fed. Rep. of Germany ..... 3218527

[51] Int. Cl.[3] ..... F01L 15/00

[52] U.S. Cl. ..... 91/239; 91/240; 91/299; 91/318; 91/337; 137/106; 137/624.14; 137/624.27

[58] Field of Search ..... 91/218, 281, 287, 299, 91/304, 317, 318, 337, 338, 239, 240, 244; 137/106, 624.14, 624.27

[56] References Cited

U.S. PATENT DOCUMENTS

| | | | |
|---|---|---|---|
| 2,090,583 | 8/1937 | Morton | 91/318 |
| 2,711,717 | 6/1955 | Stacey | 91/318 |
| 2,862,518 | 12/1958 | McAlvay | 137/624.27 |
| 3,680,583 | 8/1972 | Clair | 137/106 |
| 3,742,971 | 7/1973 | Worthington | 137/106 |

*Primary Examiner*—Robert E. Garrett
*Assistant Examiner*—Timothy E. Nauman
*Attorney, Agent, or Firm*—Salter & Michaelson

[57] ABSTRACT

This invention relates to an automatic hydraulic reversing valve for a double-action working cylinder. The purpose of the invention is to employ valves of this type without the requirement of an expensive servo-control mechanism, but nevertheless having a high operating reliability. The present invention, in avoiding the use of servo-control devices, utilizes a separate thrust piston which urges a control piston into a startup position, at which position the hydraulic medium is directed to the thrust piston end of the control piston, a blocking slide valve also being employed in the system and being mounted in the control piston for connecting the thrust piston end of the control piston to a tank or for blocking the connection to the tank.

5 Claims, 8 Drawing Figures

AUTOMATIC HYDRAULIC REVERSING VALVE FOR A DOUBLE-ACTION WORKING CYLINDER

BACKGROUND AND SUMMARY OF THE INVENTION

Figure 1:
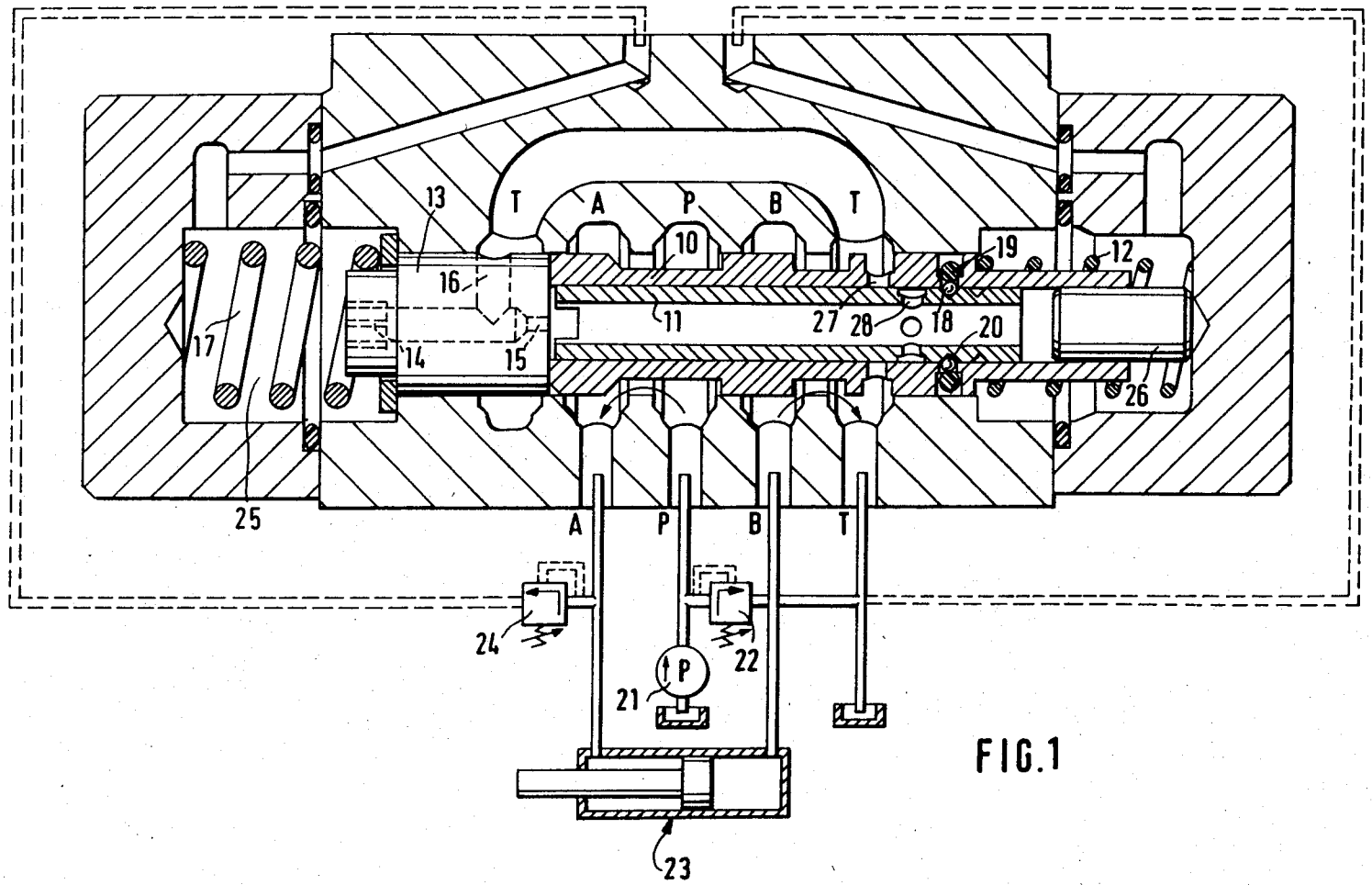
Figure 2:
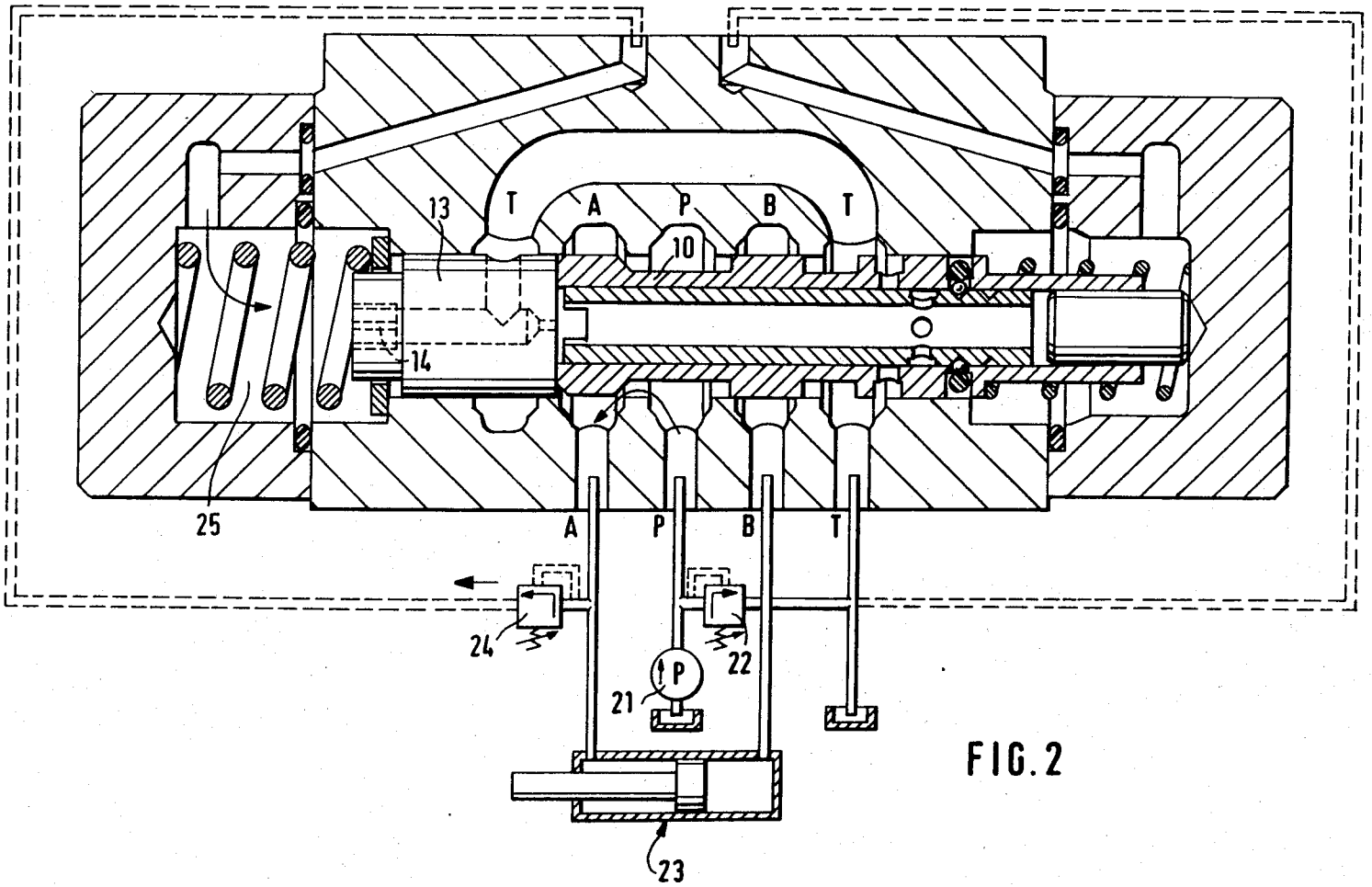
Figure 3:
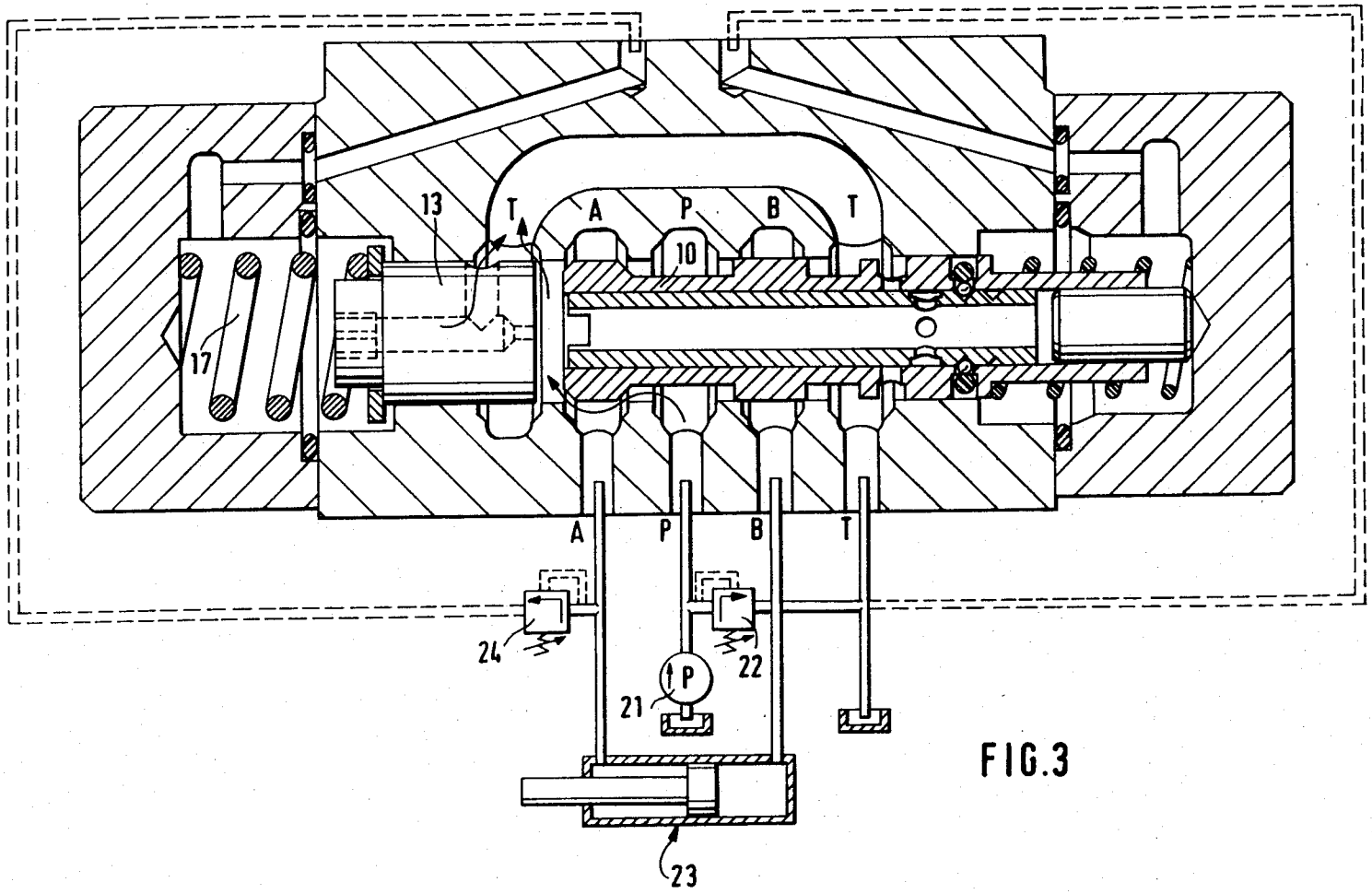
Figure 4:
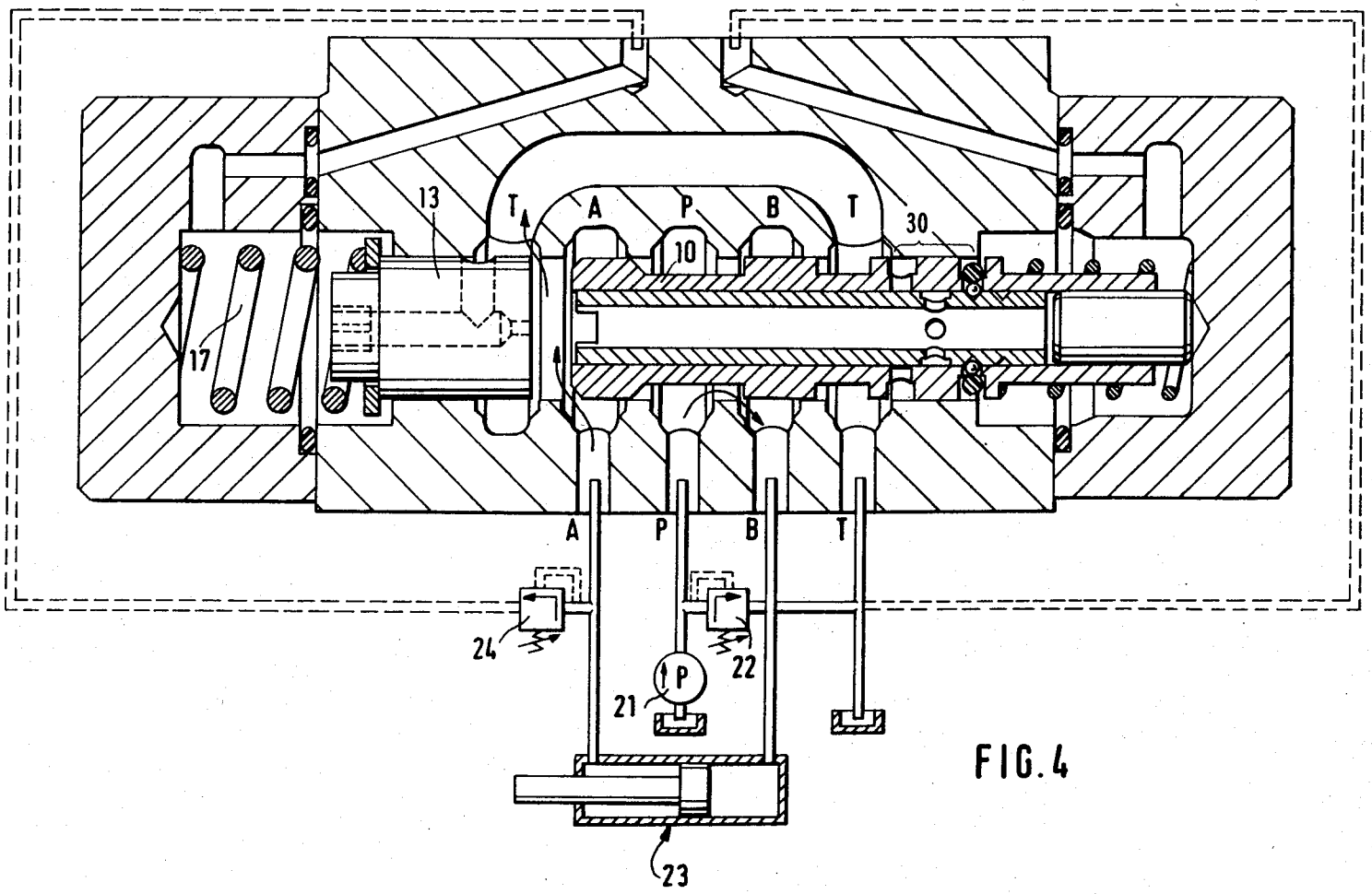

This invention relates to an automatic hydraulic reversing valve for a double-action working cyliner having a control piston operating against a return spring, with the capability of applying pressure to the other side of the piston hydraulically from a relief pressure chamber, the relief pressure chamber communicating on one side with a working connection of the working cylinder through an intermediate relief valve and on the other side to a tank through a throttle orifice.

Double-action working cylinders which reverse automatially by means of a control valve are used in many industrial systems, such as trash balers, for example, which compress the trash by means of a pressure plate. In such applications, it is required for reasons of reliability for the working cylinder to operate completely hydraulically, i.e., without electrical limit switches which are more readily susceptible to contamination and thus problems. At the same time, for reasons of safety for the operating personnel, it should be guaranteed that the working cylinders always retract, i.e., open the system, when it is turned on, for example after an emergency stop.

Known valves for the control of such double-action working cylinders generally reverse in both directions automatically as a function of the pressure, but these are so-called servo-controlled valves, whose manufacturing costs are substantial because of the expensive servo-control mechanism incorporated therein. Valves of this type that do not incorporate servo-control mechanisms therein have been described in U.S. Pat. No. 2,711,717 in 1951; but because of deficient operating reliability, valves of this type have not come into use on the market.

The purpose of this invention is to provide a control valve for controlling a double-acting working cylinder which meets the specifications described above wherein it has a high operating reliability and is substantially more economical.

The objectives of the invention are obtained by the fact that during the response of the relief valve, the control valve can be pushed into a startup position by means of a separate thrust valve that is positioned between a pressurized chamber and an associated thrust valve end of the control valve, wherein the control valve is moved from a rest position in which a pressure connection is switched to an operating connection, with the control valve in the startup position opening because of negative overlapping of the operating connection to the thrust-piston side of the control piston. In this movement the thrust-piston side of the control piston is connected to the tank through a blocking slide valve mounted in the control piston, wherein the blocking slide valve is opened by the limit stop on the spring side of the control piston and is closed by the limit stop of the control piston on the thrust-piston side.

In the valve pursuant to the invention, the control valve is pressure-dependent, i.e., when the relief valve opens it is pushed from its rest position into a starting position in which a hydraulic medium, such as oil, reaches the thrust-piston side of the control piston because of the mentioned negative overlapping, and pushes the control piston smoothly and without interference up to its limit stop. When the control piston is moved in the opposite direction by its return spring, during which it must likewise pass through the mentioned negative overlap, then a blocking slide valve mounted in the control piston provides that the oil reaching the thrust-piston side during this return motion can flow out freely into the tank through the control piston, so that the negative overlap desired for the advance motion does not obstruct the return motion of the control piston.

In an especially preferred form of embodiment of the invention, the blocking slide valve is represented by an inner tube positioned coaxially in the control piston.

Other objects, features and advantages of the invention shall become apparent as the description thereof proceeds when considered in connection with the accompanying illustrative drawings:

IN THE DRAWING

Figure 8:
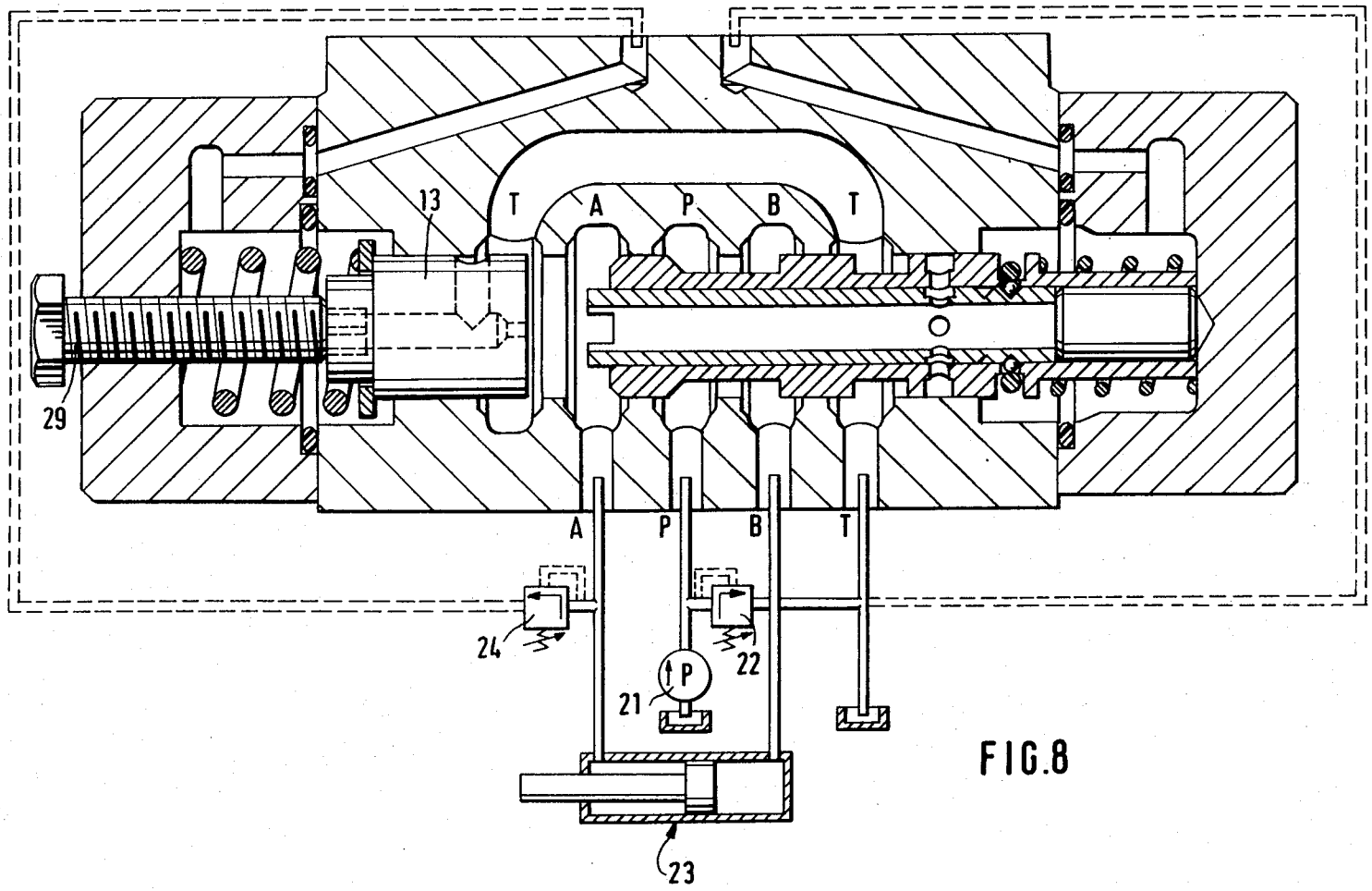

In the drawings which illustrate the best mode presently contemplated for carrying out the present invention:

FIGS. 1–7 are similar sectional views of the control valve pursuant to the invention as shown in different switching positions; and FIG. 8 is a similar sectional view as that shown in FIGS. 1–7 but further illustrates a specific form of embodiment of the control valve of the subject invention.

DESCRIPTION OF THE INVENTION

Referring now to the drawings and particularly to FIG. 1, the control valve as illustrated includes essentially the control piston 10 having an inner tube 11 that acts as a blocking slide valve and which operates against a return spring 12.

A thrust piston 13 is provided that has throttle orifices 14 and 15 formed therein and an outlet orifice 18 communicating with a tank T, the thrust piston 13 being secured in the rest position illustrated in FIG. 1 by means of a retaining spring 17. The design of the retaining spring 17 of the thrust piston 13 provides that it is stronger than the return spring 12 of the control piston 10. The inner tube 11 that is positioned in the control piston 10 functions as a blocking slide valve and can be switched into two positions, as described more precisely below, the switching positions being clearly located in the example of the embodiment illustrated by ball stays 18 which are braced radially by an O-ring 19, and which are received in either of two associated spaced notches 20.

In operation, a pressure connection or line P of the control valve as illustrated is connected to the oil-pressure pump 21, pressure line P being protected by a pressure-limiting valve 22. Operating connections A and B communicate with a working cylinder 23, and a relief valve 24 positioned in the operating line is connected to a relief pressure chamber 25 in which the spring 17 is located.

When the hydraulic pump is turned on (cf. FIG. 1), the blocking side valve 11 is located so that the oil in the control valve flows from the pressure connection P to the working connection A to the piston rod side of the working cylinder 23. The working cylinder 23 retracts or moves to the right as seen in FIG. 1. The oil displaced from the piston side of the working cylinder 23 reaches the tank T through the operating connection B.

When the working cylinder 23 reaches its maximum travel (e.g., the limit stop or maximum resistance in the system), then the oil pressure in the operating line A increases and the relief valve 24 opens, wherein oil flows into the relief pressure chamber 25. The oil can escape from this relief pressure chamber 25 only to a small extent through the relatively small throttle orifice 14 formed in the thrust piston 13, so that the thrust piston 13 is moved to the right and the control piston 10 is thus pushed into a starting position (cf. FIG. 2).

In this starting position, because of negative overlapping, the operating connection A is opened to the thrust piston side of the control piston 10, and at the same time oil can flow from the pressure connection P into the operating connection A.

The pressurized oil reaching the thrust piston side of the control piston forces the control piston 10 and the thrust piston 13 apart from one another (cf. FIG.) 3. Thus, the pressurized oil, as illustrated, then pushes the control piston 10 further to the right, and at the same time pushes the thrust piston 13 back against the force of its retaining spring 17 to such an extent that essentially a constant pressure head builds up in the gap between the two pistons, which pushes the control piston 10 further to the right, as illustrated, completely smoothly and without hammering, until the piston overlap opens the pressure connection P to the operating connection B and oil flows to the piston side of the working cylinder 23. The working cylinder then reverses its direction of motion and travels outward (cf. FIG. 4).

During the outward travel of the working cylinder 23, the oil displaced from the piston rod side of the working cylinder, which flows into the thrust-piston side of the control piston 10 in the gap between the two pistons 10 and 13), pushes the control piston 10 further forward to its limit stop on the right.

Figure 5:
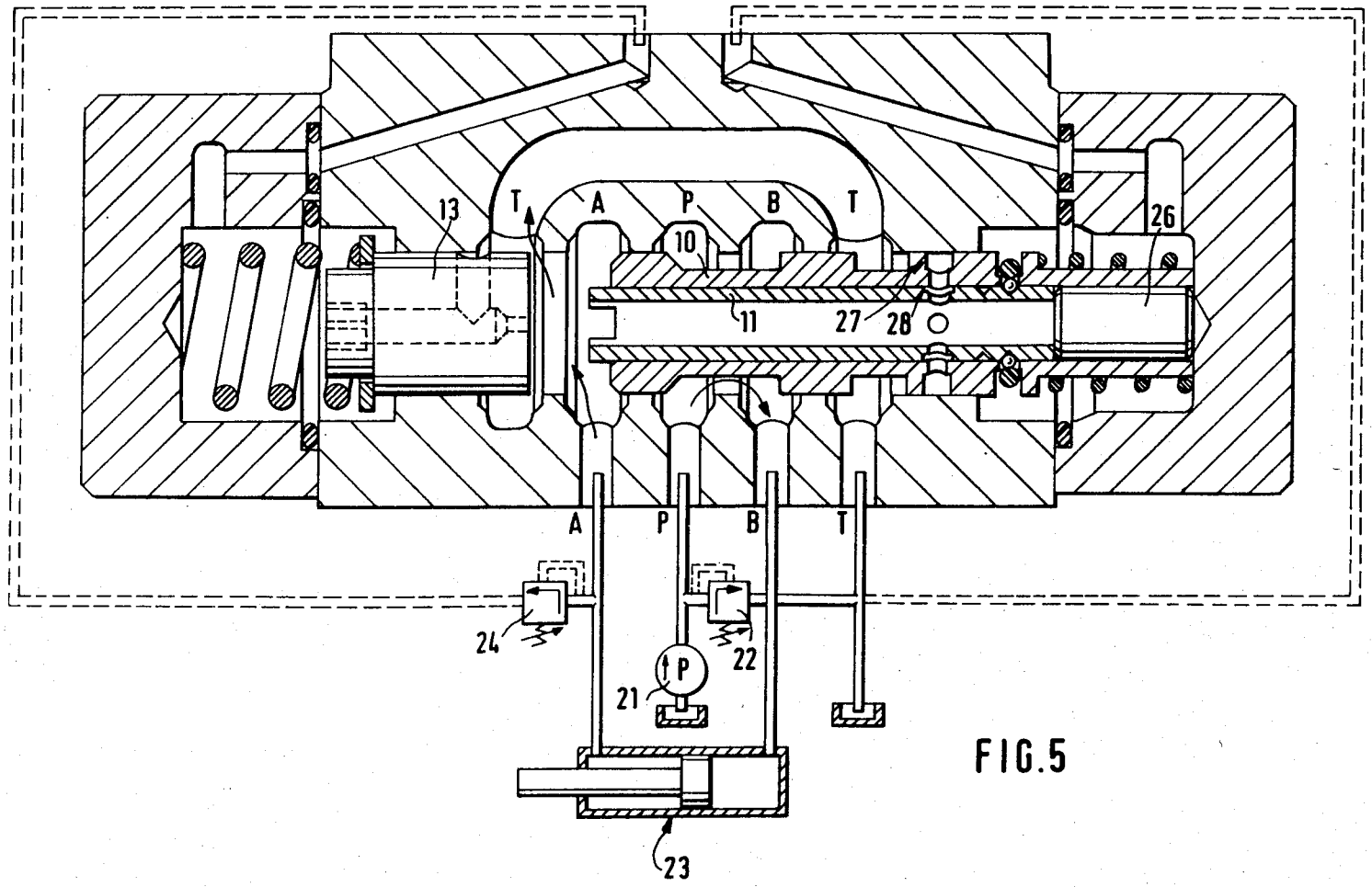
Figure 6:
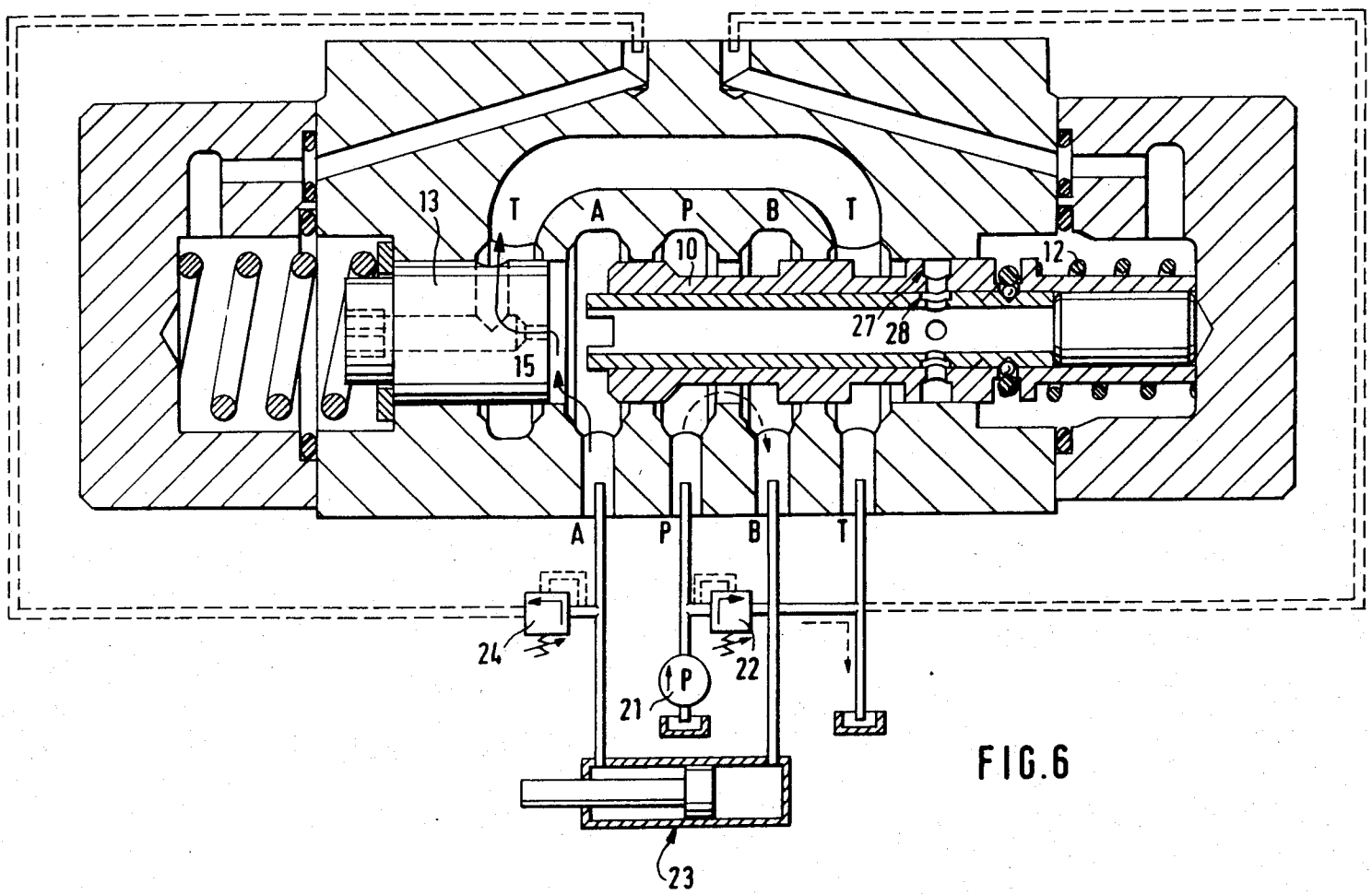
Figure 7:
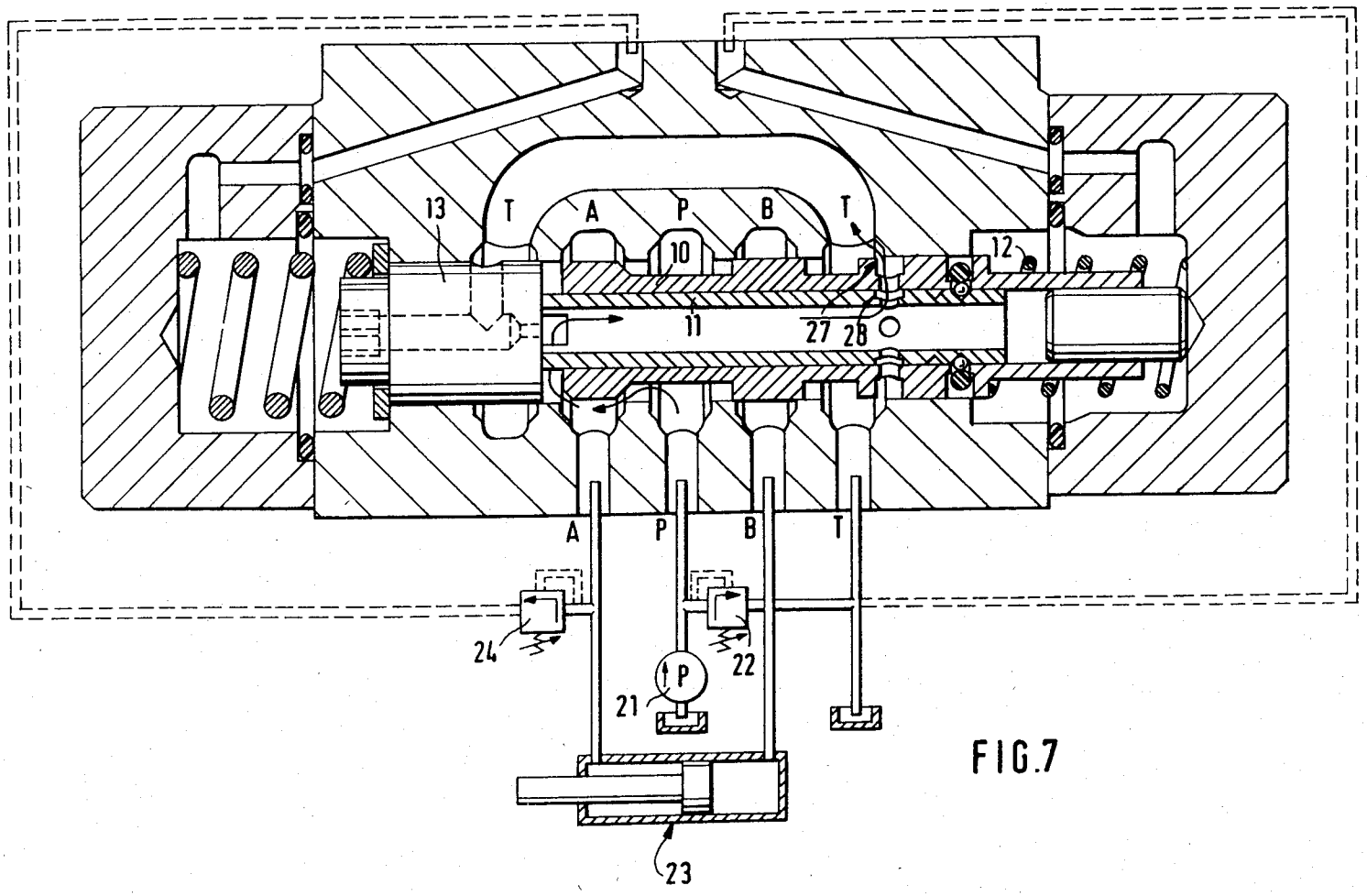

During the travel of the control piston 10 to the limit stop on its right end, the blocking side valve mounted in the control piston is switched, i.e., the inner tube 11 serving as a blocking slide valve is pushed to the left by means of a spacer 26, as illustrated, so that the orifices 27 and 28 in the control piston and the inner tube are now in alignment (cf. FIG. 5). However, this pushing of the inner tube 11 to the left starts only after the orifice 27 in the control piston 10 has been closed by the portion 30 of the stator bore for the control piston. Accordingly, due to the portion 30 of the stator bore the blocking slide valve is still closed, and therefore the alignment of the orifices 27 and 28 does not affect the switching motion of the control piston 10 from the left to the right by virtue of the pressurized oil in the gap between the two pistons 10 and 13.

When the maximum pressure set on the pressure-limiting valve 22 is then reached during the outward level of the working cylinder 23, the valve 22 opens, and some of the oil supplied by the pump 21 flows through the pressure-limiting valve 22 to the tank T. This partial quantity of the oil provided is lost by the working cylinder, and this then moves more slowly, because of which the flow of oil entering the operating connection A also becomes smaller. When this flow of oil at the operating connection A diminishes so that it can pass through the throttle orifice 15 of the thrust piston 13, then the pressure head between the two pistons 13 and 10 is then necessarily reduced, and the thrust piston 13 returns to its rest position (cf. FIG. 6).

When the pressure head between the thrust piston 13 and the control piston 10 has dropped below a certain value because of the constantly decreasing amount of oil flowing out from the piston rod end of the working cylinder 23, then the force of the return spring 12 predominates, so that the control piston 10 is moved back to the left as illustrated. During this return motion of the control piston 10 into its original rest position, the negative overlap of the pressure connection A is passed through again.

However, the oil, which flows now through this negative overlap to the gap between the two pistons 10 and 13, is diverted without hindrance through the inner tube 11 and through the aligned (opened) orifices 27 and 28 into the tank. Accordingly, the return spring 12 can move the control piston 10 back until it reaches its left limit stop (See FIG. 7).

It is seen that when the control piston 10 is to be pushed from the left to the right by virtue of the pressurized oil in the gap between pistons 10 and 13, the blocking slide valve (inner tube 11) must be closed, i.e., no oil can flow through the orifices 27 and 28 into the tank. When the control piston 10 is to be pushed from the right to the left by virtue of the return spring 12, the blocking slide valve must be opened, i.e., the oil can flow out of the gap between the two pistons 10 and 13 through the inner tube 11 and through the orifices 27 and 28 into the tank.

FIG. 8 shows a specific form of embodiment of the control valve described above, which is suitable when the working cylinder 23 is installed vertically, as is the case with pressure plate containers, for example. Since in this case the pressure plate under some circumstances can withdraw the working cylinder more rapidly than the pump can feed oil, and the risk of forming an air pocket in the working cylinder could then arise, it is provided pursuant to the invention that the throttle position of the thrust piston 13 can be adjusted in the connection from the operating connection A to the tank connection T by means of a simple adjusting screw 29.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. An automatic hydraulic reversing valve for operating a double-action working cylinder communicating therewith, a valve housing, a control piston located in said valve housing, a return spring engaging said control piston on one side for normally maintaining the control piston in a predetermined location, the other side of said control piston communicating with a relief pressure chamber formed in said housing and being subjected to hydraulic pressure from fluid directed into said chamber, said chamber being connected on the one hand to an operating connection of said working cylinder through an intermediate relief valve that communicates with a source of said fluid, and on the other hand to a reservoir tank through a throttle orifice, a thrust piston located in said housing and being responsive to a pressure buildup in said working cylinder in actuation of said relief pressure valve for moving said control piston to a starting position from a rest position, wherein the fluid source is placed in communication with said relief pressure valve for moving said thrust piston, said control piston in the starting position thereof being operable to open said operating connection to the thrust piston side of said control piston because of negative overlap, and a blocking slide valve mounted in said control piston and being operable upon movement of the control piston to connect the thrust piston side of the control piston to the reservoir tank, said blocking slide valve being opened by a limit stop of the control piston on the spring side and closed by a limit stop of the control piston on the thrust piston side.

2. A valve as claimed in claim 1, said blocking slide valve including an inner tube that is positioned coaxially in said control piston.

3. A valve as claimed in claim 2, the thrust piston side of said control piston being connected to said tank through a throttle orifice as formed in said thrust piston, said thrust piston in the rest position thereof being operable to block a line that communicates with said tank for preventing flow of fluid thereto.

4. A valve as claimed in claim 3, a retaining spring for positively locating said thrust piston in said chamber, said thrust piston being movable from its rest position against the pressure of said retaining spring into throttle positions, wherein the tank connection is opened and throttled for metering flow to said tank.

5. A valve as claimed in claim 4, the throttle positions of said thrust piston being adjusted by means of an adjustable stop.

* * * * *